US010974518B2

(12) United States Patent
Yamamoto

(10) Patent No.: US 10,974,518 B2
(45) Date of Patent: Apr. 13, 2021

(54) IMAGE FORMING APPARATUS

(71) Applicant: KYOCERA Document Solutions Inc., Osaka (JP)

(72) Inventor: Takenori Yamamoto, Osaka (JP)

(73) Assignee: Kyocera Document Solutions, Inc.

( * ) Notice: Subject to any disclaimer, the term of this patent is extended or adjusted under 35 U.S.C. 154(b) by 0 days.

(21) Appl. No.: 16/422,439

(22) Filed: May 24, 2019

(65) Prior Publication Data

US 2019/0366730 A1 Dec. 5, 2019

(30) Foreign Application Priority Data

May 29, 2018 (JP) ..... JP2018-102849

(51) Int. Cl.
*B41J 2/195* (2006.01)
*B41J 2/175* (2006.01)

(52) U.S. Cl.
CPC ..... *B41J 2/17566* (2013.01)

(58) Field of Classification Search
USPC ..... 347/7
See application file for complete search history.

(56) References Cited

U.S. PATENT DOCUMENTS

2011/0057971 A1 3/2011 Yokoyama et al.

FOREIGN PATENT DOCUMENTS

JP 2011-056721 3/2011

*Primary Examiner* — Lam S Nguyen

(57) ABSTRACT

In an image forming apparatus, a control unit (a) sets an ink residual estimation value of a subtank as a first reference value corresponding to a tank capacity of the subtank when ink empty is detected on an ink container, and determines whether the ink residual estimation value is less than the ink consumption estimation value of a subsequent page in a print job or not, and (b1) stops the print job if the ink residual estimation value is less than the ink consumption estimation value of the subsequent page and (b2) continues the print job if the ink residual estimation value is equal to or larger than the ink consumption estimation value of the subsequent page.

2 Claims, 6 Drawing Sheets

IMAGE FORMING APPARATUS

CROSS-REFERENCE TO RELATED APPLICATIONS

This application relates to and claims priority rights from Japanese Patent Application No. 2018-102849, filed on May 29, 2018, the entire disclosures of which are hereby incorporated by reference herein.

BACKGROUND

1. Field of the Present Disclosure

The present disclosure relates to an image forming apparatus.

2. Description of the Related Art

An inkjet image forming apparatus includes an ink container, a subtank, and a head, and supplies ink from the subtank to the head, replenishes ink from the ink container with the subtank; and when ink empty is detected on the ink container, if an ink residual amount of the subtank is larger than an ink usage estimation amount of a next page, then the apparatus determines that the next page can be printed, and if the ink residual amount of the subtank is less than the ink usage estimation amount of the next page, then the apparatus determines that the next page can not be printed. In this image forming apparatus, the ink usage estimation amount of the next page is calculated from (a) whether ejection is performed or not and (b) ejection droplet size of an ink droplet for each dot based on raster image data.

The aforementioned image forming apparatus can continue printing after the ink empty of the ink container. However, for directly measuring an ink residual amount of the subtank, for example, a mechanical sensor is required such that a float is floated at a liquid surface in the subtank, a position of the float is observed from the outside of the subtank and thereby the ink residual amount is determined, and therefore, it results in a high cost of the apparatus. Usually ink replenishment from the ink container to the subtank is performed when an ink residual amount of the subtank gets less than a regulated amount, and therefore, a sensor is installed to detect that the ink residual amount gets the regulated amount, but no sensors are installed to detect the ink residual amount as a continuously-variable value.

SUMMARY

An image forming apparatus according to an aspect of the present disclosure includes an ink container, a subtank with which ink from the ink container is replenished, an ink replenishment path from the ink container to the subtank, a head, a container residual amount sensor, an ink consumption estimating unit, and a control unit. The head is configured to eject the ink supplied from the subtank in accordance with a printing image. The container residual amount sensor is configured to detect ink empty of the ink container. The ink consumption estimating unit is configured to derive an ink consumption estimation value from image data of the printing image. The control unit is configured to (a) set an ink residual amount estimation value of the subtank as a first reference value corresponding to a tank capacity of the subtank when ink empty is detected on the ink container, and determine whether the ink residual amount estimation value is less than the ink consumption estimation value of a subsequent page in a print job or not, and (b1) stop the print job if the ink residual amount estimation value is less than the ink consumption estimation value of the subsequent page and (b2) continue the print job if the ink residual amount estimation value is equal to or larger than the ink consumption estimation value of the subsequent page.

These and other objects, features and advantages of the present disclosure will become more apparent upon reading of the following detailed description along with the accompanied drawings.

DETAILED DESCRIPTION

Hereinafter, an embodiment according to an aspect of the present disclosure will be explained with reference to drawings.

Figure 1:
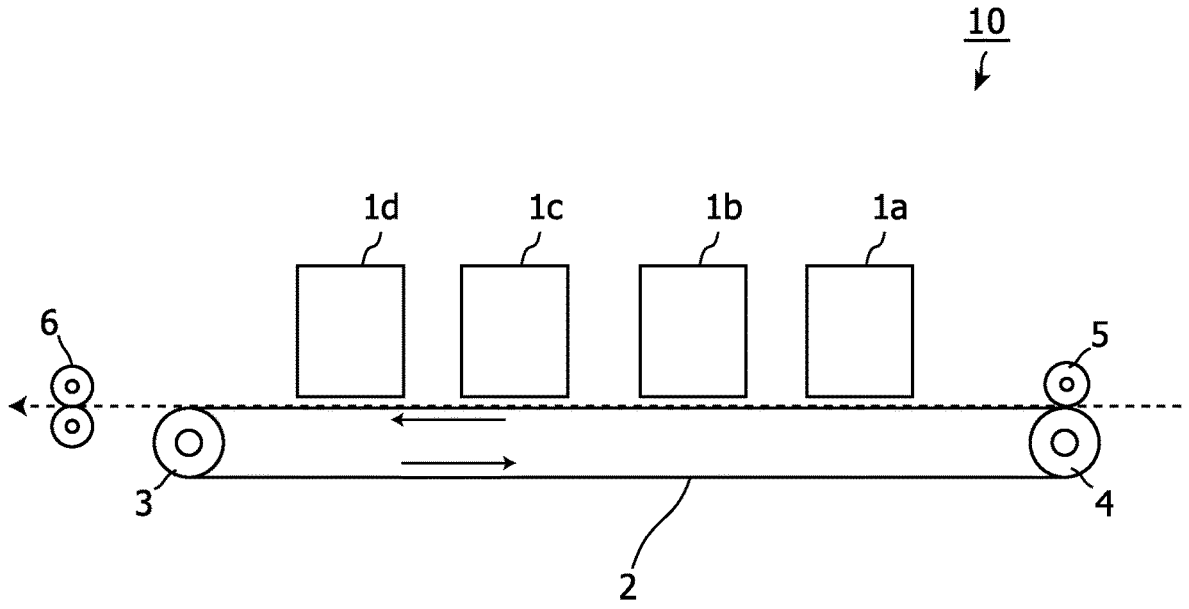
FIG. 1 shows a side view that indicates an internal mechanical configuration of an image forming apparatus in an embodiment according to the present disclosure.
Figure 2:
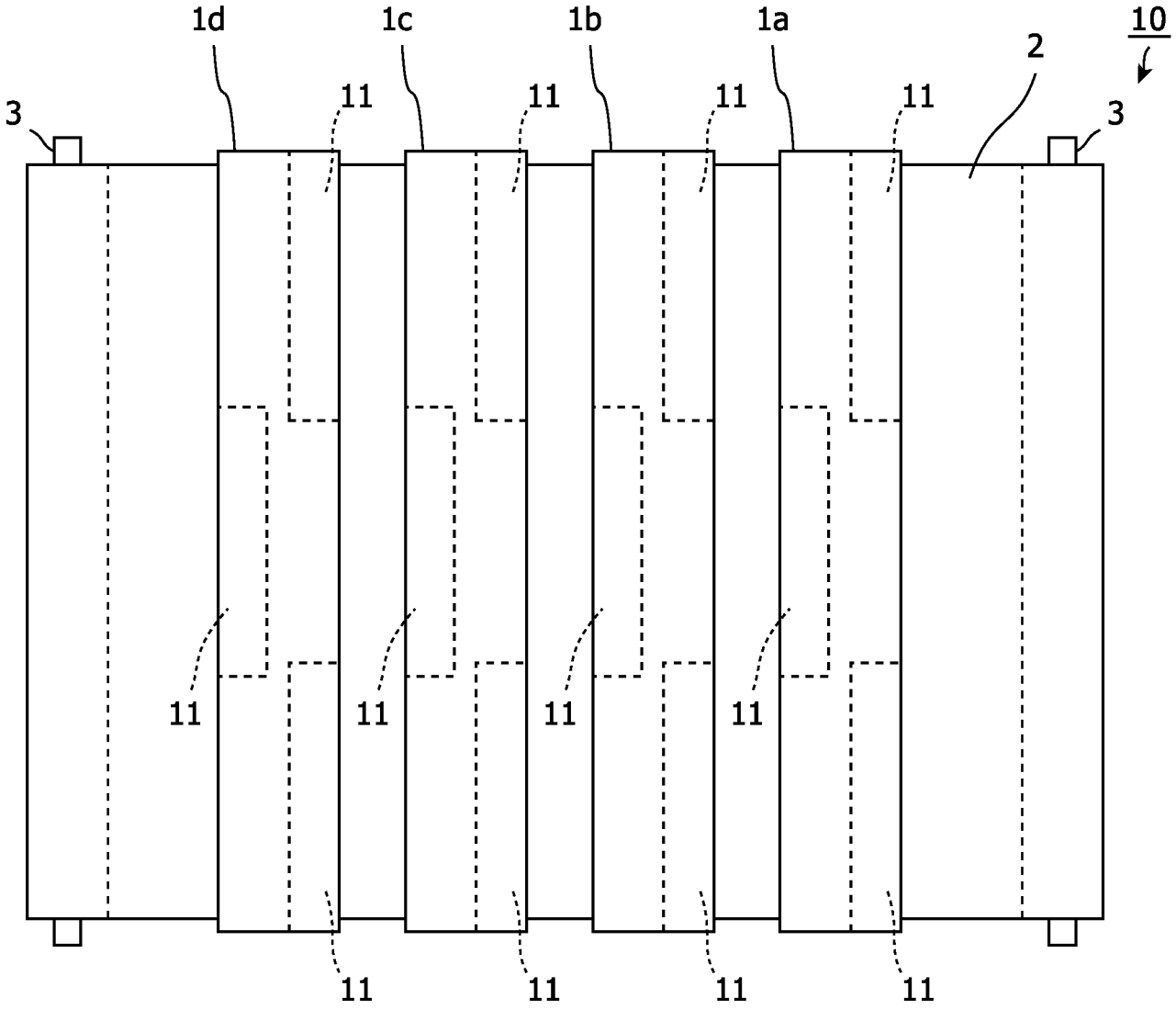
FIG. 2 shows a plane view of the image forming apparatus shown in FIG. 1.

FIG. 1 shows a side view that indicates an internal mechanical configuration of an image forming apparatus in an embodiment according to the present disclosure. FIG. 2 shows a plane view of the image forming apparatus shown in FIG. 1.

The image forming apparatus 10 in this embodiment is an apparatus such as printer, copier, facsimile machine or multi function peripheral, and has a line-type inkjet color printing mechanism.

The image forming apparatus 10 shown in FIG. 1 includes (a) line-type inkjet recording units 1*a* to 1*d* corresponding to ink colors of Cyan, Magenta, Yellow and Black, (b) a circular-type transportation belt 2 that transports a printing paper sheet, (c) a driving roller 3 and a driven roller 4 around which the transportation belt 2 is hitched, (d) a nipping roller 5 that nips the printing paper sheet with the transportation belt 2, and (e) an output roller pair 6.

The driving roller 3 and the driven roller 4 rotates the transportation belt 2. The nipping roller 5 nips an incoming printing paper sheet transported by a transportation system (not shown) from a sheet tray or the like. The nipped printing paper sheet is transported by the transportation belt 2 to printing positions of the inkjet recording units 1*a* to 1*d* in turn, and on the printing paper sheet, images of respective colors are printed by the inkjet recording units 1*a* to 1*d*. Subsequently, after the color printing, the printing paper sheet is outputted by the output roller pair 6 to an output tray (not shown) or the like.

Further, as shown in FIG. 2, in this embodiment, each inkjet recording unit 1*a*, 1*b*, 1*c* or 1*d* includes plural (here, three) head modules 11. The head modules 11 are arranged along a primary scanning direction, and are capable of being mounted to and demounted from a main body of the image forming apparatus. Thus, each head module 11 is replaceable with a new head module or a used head module. Each inkjet recording unit 1*a*, 1*b*, 1*c* or 1*d* may include only one head module 11.

Figure 3:
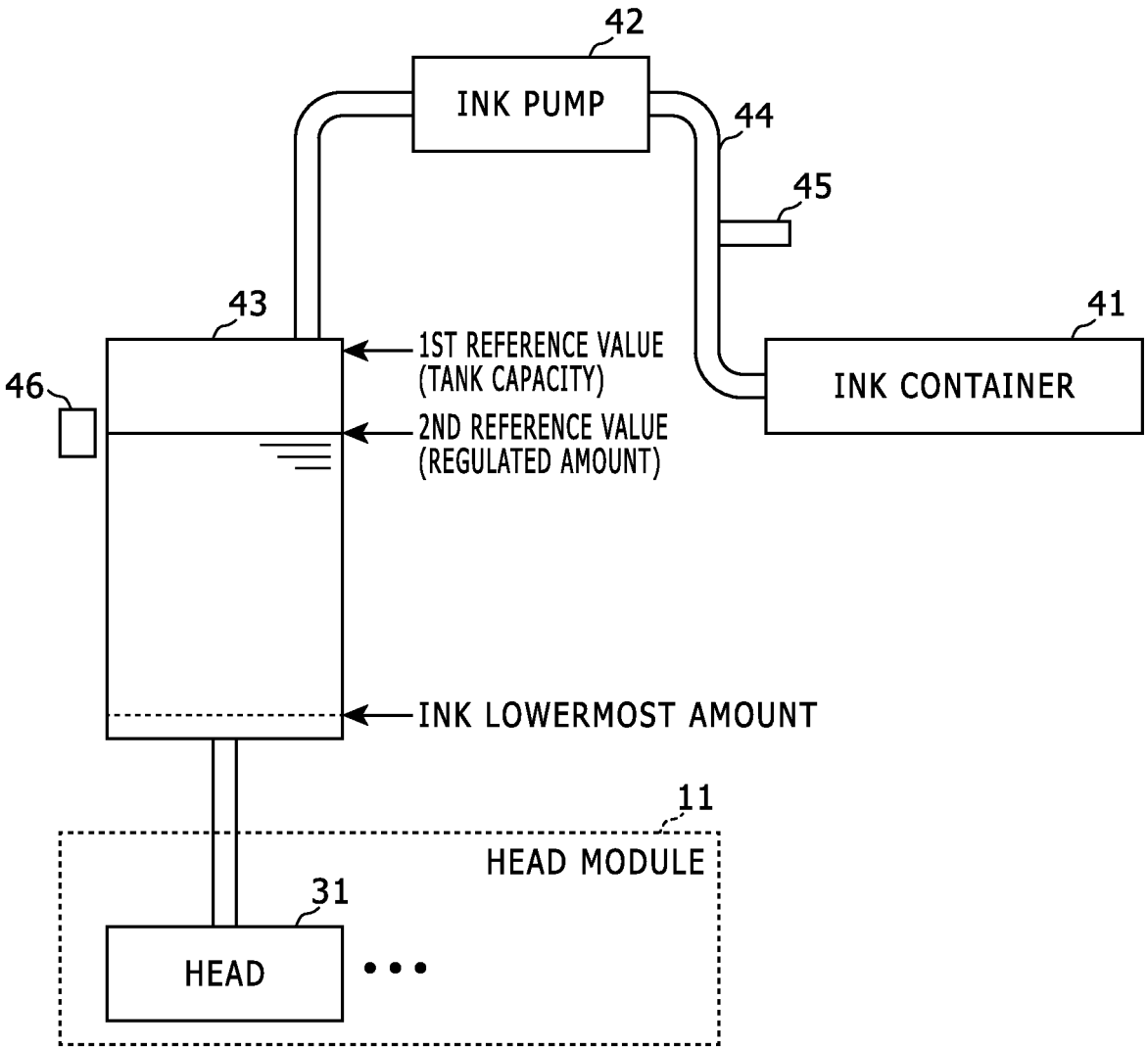
FIG. 3 shows a diagram that explains ink supply in the image forming apparatus 10 shown in FIGS. 1 and 2.

FIG. 3 shows a diagram that explains ink supply in the image forming apparatus 10 shown in FIGS. 1 and 2.

As shown in FIG. 3, each head module 11 includes plural heads 31, and the head 31 ejects ink supplied from a subtank 43 in accordance with a printing image. For example, the head 31 includes (a) a nozzle that ejects ink and (b) a piezoelectric element that causes the nozzle to eject ink in accordance with a driving voltage.

Further, as shown FIG. 3, the image forming apparatus 10 includes an ink container 41, an ink pump 42, the subtank 43, an ink replenishment path 44, a container residual amount sensor 45, and a tank regulated amount sensor 46.

The ink container 41 stores ink to be ejected by the head 31. The ink container 41 may be capable of be mounted to and demounted from the apparatus 10, and/or ink may be replenished with the ink container 41 from the outside.

The ink pump 42 replenishes ink from the ink container 41 with the subtank 43 through the ink replenishment path 44.

The subtank 43 has a predetermined tank capacity, and keeps the ink replenished from the ink container 41 and supplies the ink to the head 31.

The container residual amount sensor 45 detects ink empty of the ink container 41. For example, the container residual sensor 45 is arranged at a predetermined position in an upstream side of the ink pump 42 in the ink replenishment path 44, and determines that ink empty of the ink container 41 occurs when ink or ink flow at this predetermined position in the path 44. Alternatively, for example, the container residual sensor 45 measures a weight of the ink container 41 and determines that ink empty of the ink container 41 occurs on the basis of the measured weight.

The tank regulated amount sensor 46 detects whether an ink residual amount of the subtank 43 is less than a regulated amount or not. As the tank regulated amount sensor 46, a known sensor (i.e. a sensor that detects that an ink residual amount gets less than a regulated amount) may be used.

Figure 4:
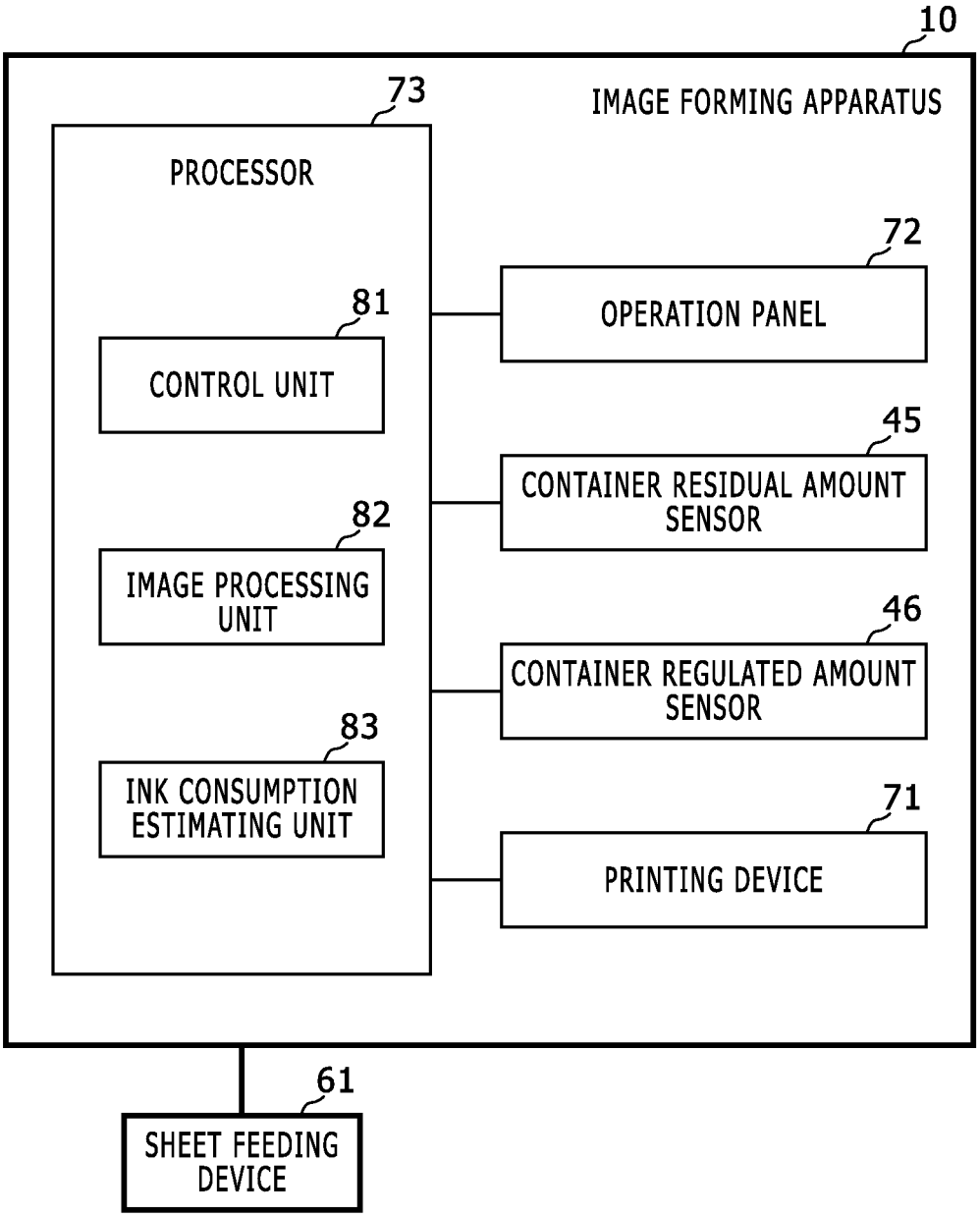
FIG. 4 shows a block diagram that indicates an electronic configuration of the image forming apparatus 10 in the embodiment according to the present disclosure.

FIG. 4 shows a block diagram that indicates an electronic configuration of the image forming apparatus 10 in the embodiment according to the present disclosure.

As shown in FIG. 4, the image forming apparatus 10 includes not only a printing device 71 that includes the mechanical configuration shown in FIGS. 1 and 2 but an operation panel 72 and a processor 73. Further, one or more sheet feeding devices 61 may be connected as an option device to the image forming apparatus 10. The sheet feeding device 61 stores a printing paper sheet and feeds and transports the printing paper sheet to the image forming apparatus 10.

For example, plural sheet feeding devices 61 are connected in a cascading manner, and feed plural printing paper sheets in parallel and sequentially transport the sheets to the image forming apparatus 10. In such a case, when a print job is performed, plural printing paper sheets are in a transportation status in a transportation path in the image forming apparatus 10 and the sheet feeding devices 61.

The operation panel 72 is arranged on a housing surface of the image forming apparatus 10, and includes a display device such as a liquid crystal display and an input device such as a hard key and/or touch panel, and displays sorts of messages for a user using the display device and receives a user operation using the input device.

The processor 73 includes a processor that acts in accordance with a program, an ASIC (Application Specific Integrated Circuit) that performs a predetermined action, and/or the like, and acts as sorts of processing units using the processor, the ASIC and/or the like. Here the processor 73 acts as a control unit 81, an image processing unit 82, and an ink consumption estimating unit 83.

The control unit 81 controls the printing device 71 and also controls each element shown in FIG. 3 for ink supply, and thereby performs a print job required by a user. The control unit 81 controls the head 31 and causes the head 31 to eject ink, and thereby forms a printing image on a printing paper sheet. Further, if the control unit 81 detects that an ink residual amount of the subtank 43 is less than a regulated amount using the tank regulated amount sensor 46, then the control unit 81 drives the ink pump 42 and thereby replenishes ink from the ink container 41 with the subtank 43. Consequently, an ink residual amount of the subtank 43 gets equal to the tank capacity.

The image processing unit 82 performs a predetermined image process such as a RIP (Raster Image Processing), a color conversion, halftoning and/or the like for image data of a printing image.

The ink consumption estimating unit 83 derives an ink consumption estimation value from image data of the printing image. Specifically, the ink consumption estimating unit 83 calculates an ink consumption amount of the printing image of each page on the basis of raster image data after the RIP.

Further, the control unit 81 determines whether printing requested as a print job is feasible without air entrainment of the head 31 or not on the basis of the ink residual amount estimation amount and the ink consumption estimation amount. Specifically, the control unit 81(*a*) sets an ink residual amount estimation value of the subtank 43 as a first reference value corresponding to a tank capacity of the subtank 43 when ink empty is detected on the ink container 41 by the container residual amount sensor 45, and determines whether the ink residual amount estimation value is less than the ink consumption estimation value of a subsequent page in a print job (for example, one or more unprinted pages remaining in the print job at a time point that the ink empty of the ink container 41 is detected, one or more unprinted pages to be printed on one or more printing paper sheets in a transportation status at a time point that the ink empty of the ink container 41 is detected) or not, and (b1) stops the print job if the ink residual amount estimation value is less than the ink consumption estimation value of the subsequent page and (b2) continues the print job if the ink residual amount estimation value is equal to or larger than the ink consumption estimation value of the subsequent page.

Further, in this embodiment, the control unit 81 sets the ink residual amount estimation value as a second reference value corresponding to the regulated amount immediately when the tank regulated amount sensor 46 detects that an ink residual amount of the subtank 43 is less than the regulated amount.

Furthermore, in this embodiment, (a) the control unit 81 renews the ink residual amount estimation value with a value obtained by subtracting the ink consumption estimation value from the ink residual amount estimation value; (b) if the ink residual amount estimation value is equal to or larger than the ink consumption estimation value of the subsequent page and the print job is continued, then the control unit 81 determines whether the ink residual amount estimation amount is less than the ink consumption estimation amount of a next print job or not when the next print job is performed; and the control unit 81 (c1) does not perform the next print job if the ink residual amount estimation amount is less than the ink consumption estimation amount of the next print job, and otherwise (c2) performs the next print job if the ink residual amount estimation amount is equal to or larger than the ink consumption estimation amount of the next print job.

Furthermore, in this embodiment, the ink consumption estimating unit 83 derives the ink consumption estimation value of the print image before starting feeding a printing paper sheet on which the print image is printed; and before starting feeding the printing paper sheet for the print image of which the ink consumption estimation value has been derived, the control unit 81 (a) determines whether the ink residual amount estimation value is less than the ink consumption estimation value or not, and (b) stops the print job and cancels feeding the printing paper sheet if the ink residual amount estimation value is less than the ink consumption estimation value.

It should be noted that the aforementioned first reference value is a difference between the tank capacity and a lower most amount of the ink in the subtank 43, and the lower most amount is set such that air entrainment to the head 31 does not occur; and the aforementioned second reference value is a difference between the regulated amount and the lower most amount.

Figure 5:
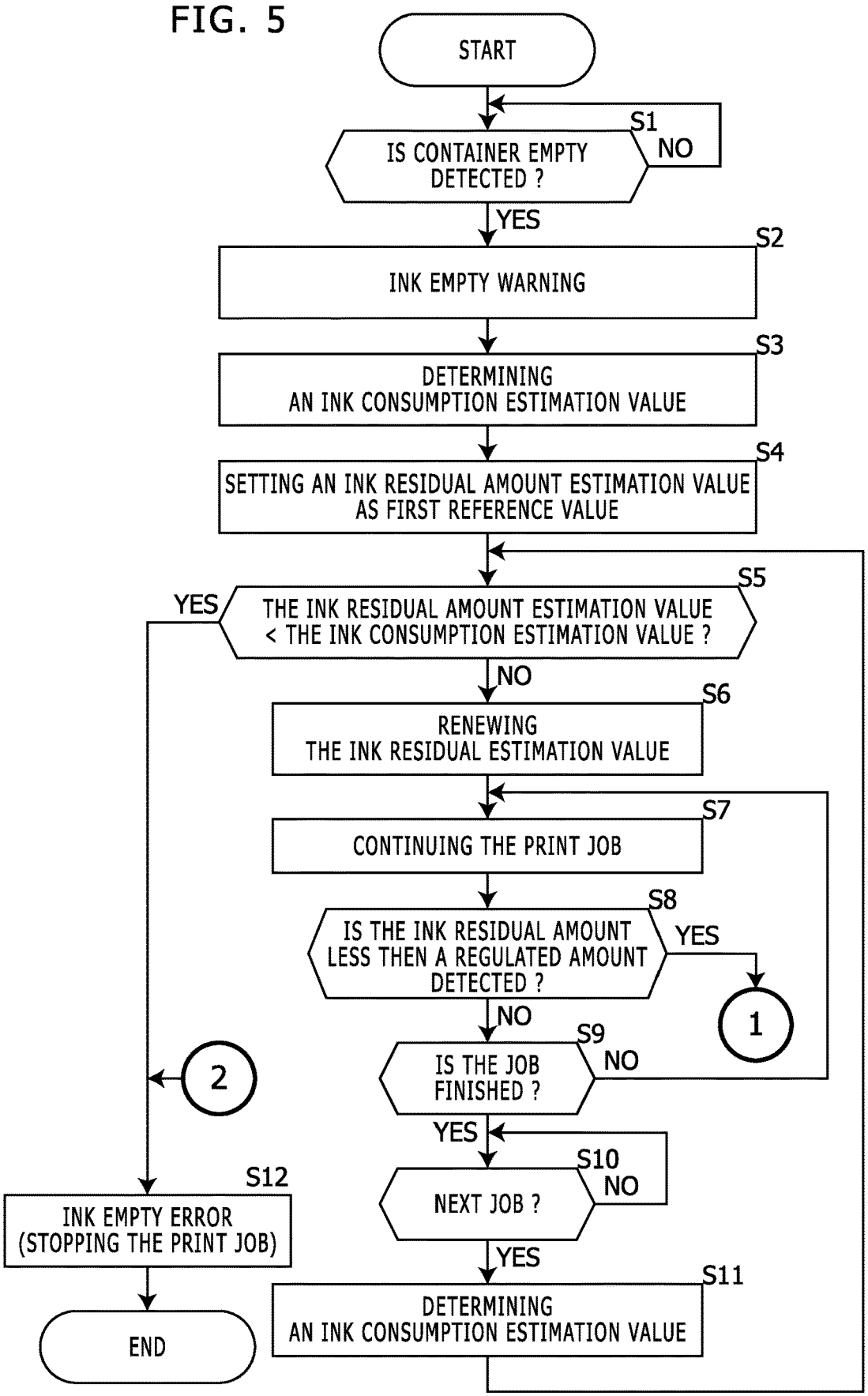
FIG. 5 shows a flowchart that explains a behavior of the image forming apparatus shown in FIGS. 1 to 4 (1/2)
Figure 6:
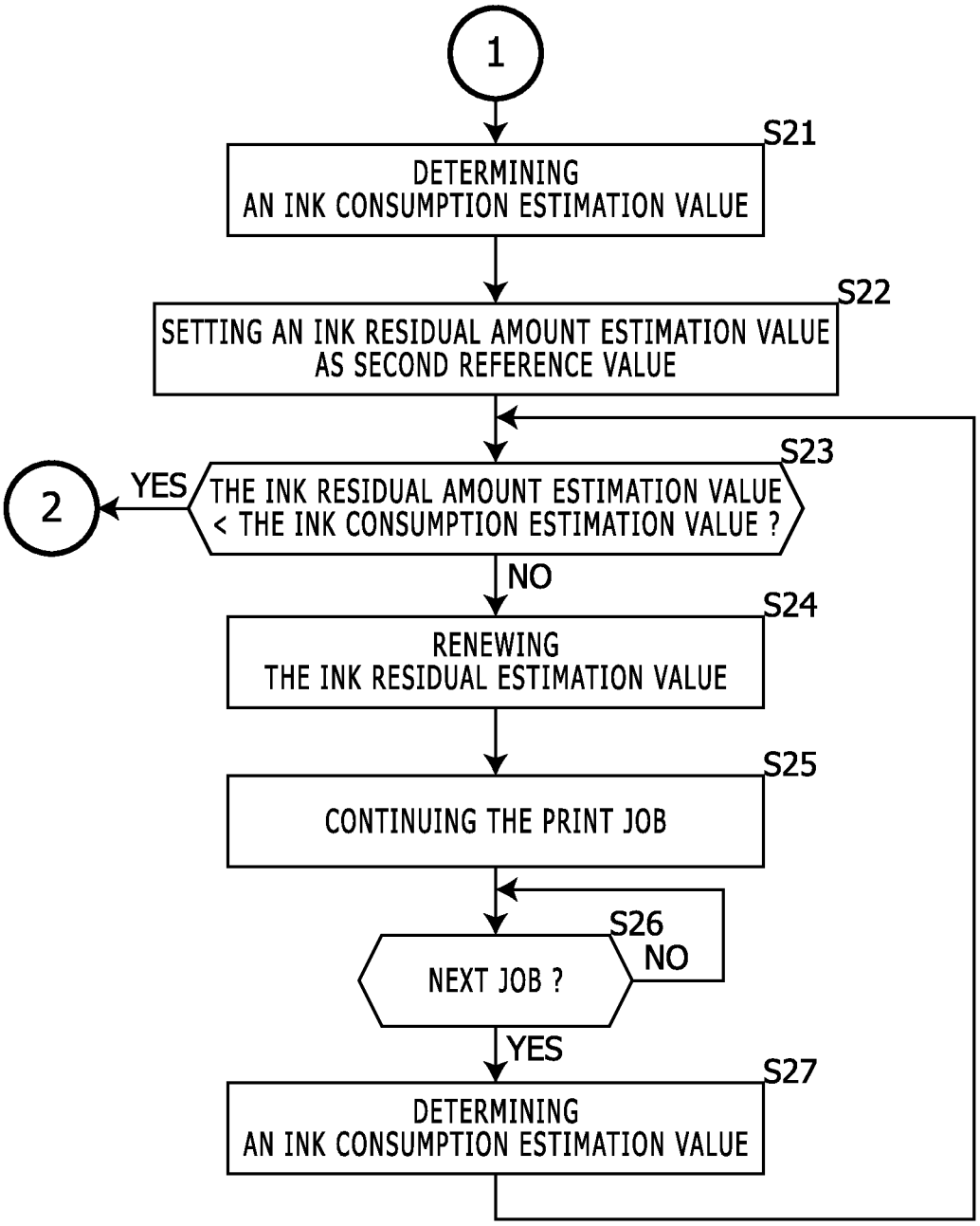
FIG. 6 shows a flowchart that explains a behavior of the image forming apparatus shown in FIGS. 1 to 4 (2/2).

The following part explains a behavior of the image forming apparatus in this embodiment. FIGS. 5 and 6 show a flowchart that explains a behavior of the image forming apparatus shown in FIGS. 1 to 4.

The control unit 81 starts a print job and thereafter watches an output signal of the container residual sensor 45, and repeatedly determines whether ink empty of the ink container 41 (i.e. container empty) occurs or not (in Step S1).

If the container empty is detected before the end of the print job, the control unit 81 displays a message of ink empty warning on the operation panel 72 (in Step S2). At this time point, the print job is not stopped.

Further, the control unit 81 determines an ink consumption estimation value of one or more unprinted subsequent page (in Step S3), and at this time point, sets an ink residual amount estimation value as the first reference value (in Step S4).

Subsequently, the control unit 81 determines whether the current ink residual amount estimation value is less than the aforementioned ink consumption estimation value or not (in Step S5).

If the current ink residual amount estimation value is not less than the aforementioned ink consumption estimation value, then the control unit 81 renews the ink residual amount estimation value with a value obtained by subtracting the aforementioned ink consumption estimation value from the current ink residual amount estimation value (in Step S6), and continues the print job (in Step S7). Subsequently, until the end of the print job, the control unit 81 watches whether an ink residual amount less than the regulated amount is detected or not by the tank regulated amount sensor 46 (in Steps S7 to S9).

If the print job is finished without the detection of an ink residual amount less than the regulated amount, then when the control unit 81 is requested a next print job (in Step S10), the control unit 81 determines an ink consumption estimation amount of this next job using the ink consumption estimating unit 83 (in Step S11), and performs a process in Step S5 and subsequent steps again.

Contrarily, in Step S5, if the control unit 81 determines that the current ink residual amount estimation value is less than the aforementioned ink consumption estimation value, then the control unit 81 displays a message of an ink empty error and stops the print job because the ink is not sufficient to be used until the print job is finished (in Step S12).

Further, in Step S8, if an ink residual amount less than the regulated amount is detected by the tank regulated amount sensor 46 while the print job is performed, then the control unit 81 determines an ink consumption estimation value of a remaining pages of the print job using the ink consumption estimating unit 83 (in Step S21), and sets the ink residual amount estimation value as the second reference value (in Step S22).

Subsequently, the control unit 81 determines whether the current ink residual amount estimation value is less than the aforementioned ink consumption estimation value or not (in Step S23).

If the current ink residual amount estimation value is less than the aforementioned ink consumption estimation value, then the control unit 81 renews the ink residual amount estimation value with a value obtained by subtracting the aforementioned ink consumption estimation value from the current ink residual amount estimation value (in Step S24), and continues the print job (in Step S25).

When the print job is finished, upon a request of a next print job (in Step S26), the control unit 81 determines an ink consumption estimation value of this next print job using the ink consumption estimating unit 83 (in Step S27), and performs a process in Step S23 and subsequent steps again.

In Step S23, if the control unit 81 determines that the current ink residual amount estimation value is less than the aforementioned ink consumption estimation value, then the control unit 81 displays a message of an ink empty error and stops the print job because the ink is not sufficient to be used until the print job is finished (in Step S12).

As mentioned, in the aforementioned embodiment, the control unit 81 (a) sets an ink residual amount estimation value of the subtank 43 as a first reference value corresponding to a tank capacity of the subtank 43 when ink empty is detected on the ink container 41, and determines whether the ink residual amount estimation value is less than the ink consumption estimation value of a subsequent page in a print job or not, and (b1) stops the print job if the ink residual amount estimation value is less than the ink consumption estimation value of the subsequent page and (b2) continues the print job if the ink residual amount estimation value is equal to or larger than the ink consumption estimation value of the subsequent page.

Consequently, after the ink empty of the ink container 41, the print job is continued while the air entrainment to the head 31 is restrained using the known tank regulated amount sensor 46 for controlling the ink replenishment.

Further, in another image forming apparatus that compares an actual ink residual amount in a subtank and an ink usage estimation amount for a subsequent page with each other when ink empty of an ink container appears, printing is immediately stopped if the ink usage estimation amount is larger than the actual ink residual amount in the subtank. Contrarily, in the aforementioned embodiment, an ink residual amount estimation value of the subtank 43 is set as the first reference value corresponding to the tank capacity of the subtank 43, and thereby it is properly determined whether printing should be continued or not. In other words, a sum of (a) ink larger than the regulated amount in the subtank 43 and (b) ink remaining in the ink replenishment path 44 is larger than the capacity of the subtank 43, and therefore, even if the ink usage estimation amount gets larger than the actual ink residual amount in the subtank 43 but equal to or less than the first reference value, printing can be continued.

It should be understood that various changes and modifications to the embodiments described herein will be apparent to those skilled in the art. Such changes and modifications may be made without departing from the spirit and scope of the present subject matter and without diminishing its intended advantages. It is therefore intended that such changes and modifications be covered by the appended claims.

What is claimed is:

1. An image forming apparatus, comprising:

an ink container;

a subtank with which ink from the ink container is replenished;

an ink replenishment path from the ink container to the subtank;

a head configured to eject the ink supplied from the subtank in accordance with a printing image;

a container residual amount sensor configured to detect ink empty of the ink container;

an ink consumption estimating unit configured to derive an ink consumption estimation value from image data of the printing image;

a control unit configured to (a) set an ink residual amount estimation value of the subtank as a first reference value corresponding to a tank capacity of the subtank when ink empty is detected on the ink container, and determine whether the ink residual amount estimation value is less than the ink consumption estimation value of a subsequent page in a print job or not, and (b1) stop the print job if the ink residual amount estimation value is less than the ink consumption estimation value of the subsequent page and (b2) continue the print job if the ink residual amount estimation value is equal to or larger than the ink consumption estimation value of the subsequent page;

a tank regulated amount sensor configured to detect whether an ink residual amount of the subtank is less than a regulated amount or not; and an ink pump configured to replenish ink from the ink container with the subtank through the ink replenishment path, wherein the control unit sets the ink residual amount estimation value as a second reference value corresponding to the regulated amount immediately when the tank regulated amount sensor detects that an ink residual amount of the subtank is less than the regulated amount.

2. The image forming apparatus according to claim 1 wherein the first reference value is a difference between the tank capacity and a lower most amount of the ink in the subtank, and the lower most amount is set such that air entrainment to the head does not occur; and the second reference value is a difference between the regulated amount and the lower most amount.

* * * * *